US010890034B2

(12) United States Patent
Wijning et al.

(10) Patent No.: US 10,890,034 B2
(45) Date of Patent: Jan. 12, 2021

(54) COMBINATION OF A DRILLING INSTALLATION AND A CONTROL AND SIGNAL LINES DEPLOYMENT MODULE AND METHOD OF USE

(71) Applicant: ITREC B.V., Schiedam (NL)

(72) Inventors: Diederick Bernardus Wijning, Schiedam (NL); Joop Roodenburg, Schiedam (NL)

(73) Assignee: ITREC B.V., Schiedam (NL)

( * ) Notice: Subject to any disclaimer, the term of this patent is extended or adjusted under 35 U.S.C. 154(b) by 0 days.

(21) Appl. No.: 16/776,116

(22) Filed: Jan. 29, 2020

(65) Prior Publication Data

US 2020/0165879 A1 May 28, 2020

Related U.S. Application Data

(62) Division of application No. 16/062,850, filed as application No. PCT/NL2016/050884 on Dec. 16, 2016, now Pat. No. 10,590,714.

(30) Foreign Application Priority Data

Dec. 18, 2015 (NL) ..... 2015991

(51) Int. Cl.

| | |
|---|---|
| ***E21B 17/02*** | (2006.01) |
| ***E21B 19/10*** | (2006.01) |
| ***E21B 19/24*** | (2006.01) |

(52) U.S. Cl.

CPC ..... *E21B 17/026* (2013.01); *E21B 19/10* (2013.01); *E21B 19/24* (2013.01)

(58) Field of Classification Search

CPC ..... E21B 17/026; E21B 19/10; E21B 19/24

(Continued)

(56) References Cited

U.S. PATENT DOCUMENTS

| | | | |
|---|---|---|---|
| 4,208,158 | A | 6/1980 | Davies et al. |
| 6,131,664 | A | 10/2000 | Sonnier |

(Continued)

FOREIGN PATENT DOCUMENTS

WO WO 2014/182160 A2 11/2014

OTHER PUBLICATIONS

International Search Report, issued in PCT/NL2016/050884, dated Mar. 31, 2017.

(Continued)

*Primary Examiner* — Matthew R Buck
*Assistant Examiner* — Patrick F Lambe
(74) *Attorney, Agent, or Firm* — Birch, Stewart, Kolasch & Birch, LLP

(57) ABSTRACT

A combination of a drilling installation for drilling a well and a control and signal lines deployment module is disclosed. The drilling installation includes a rig floor slip device adapted to be cleared from a well centre opening to create a clear space around the well centre opening. The combination includes a temporary workspace floor, adapted to be mounted in the clear space at a level below a rig floor surface and to provide a workspace floor for an operator standing in said clear space on the work space floor, allowing the operator to secure at a securing level said one or more control/and or signal lines externally to a second tubulars string suspended from a module slip device.

12 Claims, 9 Drawing Sheets

(58) Field of Classification Search
USPC ..... 166/77.1
See application file for complete search history.

(56) References Cited

U.S. PATENT DOCUMENTS

| | | | | |
|---|---|---|---|---|
| 8,807,230 | B2 | 8/2014 | Sonnier | |
| 2006/0065404 | A1 | 3/2006 | Pennison et al. | |
| 2012/0031627 | A1* | 2/2012 | Sonnier | E21B 17/026 166/379 |
| 2012/0090828 | A1 | 4/2012 | Webre et al. | |

OTHER PUBLICATIONS

Written Opinion of the International Searching Authority, issued in PCT/NL2016/050884, dated Mar. 31, 2017.

* cited by examiner

COMBINATION OF A DRILLING INSTALLATION AND A CONTROL AND SIGNAL LINES DEPLOYMENT MODULE AND METHOD OF USE

CROSS-REFERENCE TO RELATED APPLICATIONS

This application is a Divisional of copending U.S. application Ser. No. 16/062,850, filed on Jun. 15, 2018, which is the National Phase of PCT International Application No. PCT/NL2016/050884, filed on Dec. 16, 2016, which claims priority under 35 U.S.C. § 119(a) to Application No. 2015991, filed in Netherlands on Dec. 18, 2015, all of which are hereby expressly incorporated by reference into the present application.

The present invention relates to a combination of a drilling installation for drilling a well and a control and signal lines deployment module, and a method wherein use is made of a drilling installation for drilling a well to deploy a second tubulars string to which one or more control and/or signals lines are externally secured. The drilling installation comprises a drilling tower, a rig floor having a well centre opening and a rig floor surface, and a rig floor slip device which is adapted to be arranged at said well centre opening and to suspend therefrom a first tubulars string into the well.

In cases, it is desired that a second tubulars string is deployed through said well centre opening into a well, to which one or more control and/or signals lines are externally secured. It is noticed that references to a first tubulars string relate to a string suspended from the rig floor slip device, and references to a second tubulars string relate to a tubulars string to which one or more control and/or signals lines are externally secured. The type of tubulars, e.g. drill pipe, casing, production tubing, may be the same: the difference is whether or not lines are secured to it.

A typical example of such a second tubulars string is a production string. Oil and gas and other minerals produced by wells drilled into the earth are conveyed through the well to the well surface by a pipe string referred to as a production string. The completion of a well using production tubing requires the installation of control lines for electrically, hydraulically or optically linking various downhole devices to the surface. Control lines may be used to receive data from downhole instruments, e.g. to monitor, regulate and stimulate the flow of the fluids through the production tubing string, e.g. by selectively operating, from the surface, downhole devices such as valves, switches, sensors, relays or other devices. Control and signal lines may carry electric signals, electrical power, hydraulic signals and/or power, optic signals, pneumatic signals and/or power, etc.

Control lines secured to a tubulars string are liable to being damaged and made useless if pinched or crushed by a slip device used to grip and support the second tubulars string, such as during the process of making up the production tubing string and running it into or removing it from the well.

It is common practice to use clamps to secure the control lines to the second tubulars string at predetermined intervals along the second tubulars string by an operator, at a level below the slip device.

To this end, control and signal lines deployment modules are known which are adapted to deploy a second tubulars string to which one or more control and/or signals lines are externally secured through said well centre opening into the well, which are movable between an operative position, wherein the control and signal lines deployment module is positioned over the well centre opening, and a remote parking position, the control and signal lines deployment module comprising:

- a support structure adapted to be positioned over the well centre opening in the operative position;
- a work platform supported by the support structure, which work platform is at a height above the rig floor surface in the operative position of the control and signal lines deployment module;
- a module slip device supported by the support structure, which module slip device is at a height above the rig floor surface in the operative position of the module and is adapted to suspend a second tubulars string through the well centre opening such that a top end of said module slip device is within reach of an operator standing on said work platform;
- one or more line guides below said work platform and adapted to guide one or more control and/or signal lines from one or more supply spools along a path to a securing level below said module slip device allowing an operator to secure said one or more control and/or signals lines externally to said second tubulars string suspended from said module slip device.

Such a control and signal lines deployment module is e.g. known from U.S. Pat. No. 6,131,664 and from U.S. Pat. No. 4,208,158, wherein the operator stands on the rig floor, or wherein an elevated workspace floor is provided for the operator.

The aim of the present invention is to provide an improved control and signal lines deployment module. For example a disadvantage of known control and signal lines deployment module resides in the height of the known modules.

The invention achieves this aim by providing that the rig floor slip device is adapted to be cleared from said well centre opening to create a clear space around the well centre opening; and in that the combination further comprises a temporary workspace floor, which is adapted to be mounted in the clear space at a level below the rig floor surface and to provide a workspace floor for an operator standing in said clear space on said work space floor, allowing said operator to secure at said securing level said one or more control/and or signal lines externally to said second tubulars string suspended from said module slip device.

This has the advantage that the work platform can be provided at a relatively reduced or limited distance above the rig floor than with the known control and signal lines deployment modules, while assuring a similar operator's workspace. The reduced height may be beneficial in view of the total height of the drilling tower and the location of the tubulars storage relative to the rig floor. Due to the reduced height of the module, optimally long tubular stands can be moved from the storage device above the module slip device without requiring increased height of the tower and/or without needing to arrange the tubular storage at an increased height relative to the rig floor. These effects translate in enhanced stability of the vessel, high efficiency of the deployment, etc. Also the reduced height may be beneficial in view of visibility of the make-up and break-up of the tubular string and of the operator assisting in securing the control and signal lines from a drillers cabin, e.g. arranged adjacent the drill floor. Also, as the support structure has to bear the load of an entire tubulars string suspended from the module slip device, the reduced height is beneficial in a relatively lightweight construction of the support structure compared to the taller prior art designs.

Hence, according to the invention, when a second tubulars string to which one or more control and/or signals lines are externally secured is run through a firing line into the well, the temporary workspace floor is provided at a level below the rig floor. Advantageously, the temporary workspace floor is positioned 1-2 metres, preferably about 1.50 metres, below the rig floor surface. Advantageously, the operator's head and thus view is above the rig floor surface. The securing level is at an operating height of the operator, i.e. at about 1.5 metres from the temporary workspace floor. As a result, the securing level is essentially level with the rig floor surface. There above the line guides and module slip device for production tubing are provided.

According to the invention, the rig floor slip device is adapted to be cleared from said well centre opening to create a clear space around the firing line. Advantageously, the clear space has a diameter of at least 2 metres, e.g. a square space of about 4×4 $m^2$, to allow the operator to walk over the workspace floor and to move around the tubular string suspended from the module slip device in the firing line.

Possibly, the rig floor slip device can be lifted upwards and moved away from the firing line. Alternatively, a skid system may be provided to translate the rig floor slip device away from the well centre opening. In embodiments, the rig floor slip device comprises two clamp parts which move in opposite directions, away from the well centre opening.

In embodiments, the rig floor slip device is displaceable along horizontal rails, and wherein the workspace floor is adapted to be positioned onto the rails.

Advantageously, a ladder is provided, which is adapted to be provided between the workspace floor and the rig floor.

In embodiments, one or more supply spools are provided. The supply spools may have a horizontal axis, and are preferably supported at a level just above the rig floor surface. In embodiments, the control and signal lines deployment module further comprises the one or more supply spools, which are supported by the support structure. In alternative embodiments, the one or more supply spools are provided on the rig floor surface.

In embodiments, the control and signal lines deployment module further comprises one or securing tools, supported by the support structure at said securing level.

Control and signal lines are generally of a small diameter relative to the diameter of the pipe string to which they are secured, and are generally between 0.5 and 8 cm in diameter. A plurality of control lines may be aggregated into a single umbilical that may exceed 15 cm in diameter.

In embodiments, a catwalk device is provided, both for the supply of tubulars to be handled at the rig floor surface and the supply of tubulars to be handled at the work platform of the control and signal lines deployment module.

In embodiments, the one or more line guides include one or more of shaped guides, roller guides, slides, cable funnels and the like, either alone or in combination.

In embodiments, the support structure of the control and signal lines deployment module in a first operative position is adapted to stand stationary on the rig floor over the well centre opening, and/or wherein the support structure of the control and signal lines deployment module in a second operative position is provided heave compensated above the well centre opening.

In practice, the support structure of the control and signal lines deployment module is positioned stationary on the rig floor during particular operations, with the temporary workspace floor mounted in the clear space at a level below the rig floor surface. In addition thereto, or instead thereof, it may be desired to provide heave compensation to the support structure of the control and signal lines deployment module. In such a configuration, it is conceivable that the temporary workspace floor is dispensed with. It is also conceivable that the temporary workspace floor is also heave compensated together with the support structure, e.g. because the temporary workspace floor is suspended from the support structure.

In embodiments of the second operative position wherein the support structure is provided heave compensated above the well centre opening, it is both conceivable that the support structure of the control and signal lines deployment module is supported by a rigid riser tension frame which is supported heave compensated by the drilling tower, and that the support structure of the control and signal lines deployment module is supported by an internally heave compensated riser tension frame supported by the drilling tower.

In practice, so-called riser tension frames supported by a tower, such as a drilling tower, are known to provide heave compensation. Rigid riser tension frames are known, which provide heave compensation as they are suspended in a heave compensated way, e.g. via a heave compensated cable and winch system. Alternatively, internally heave compensated riser tension frames are known which are e.g. provided with cylinders to provide the heave compensation.

In alternative embodiments of the second operative position wherein the support structure is provided heave compensated above the well centre opening, the support structure of the control and signal lines deployment module is supported via heave compensation cylinders on the rig floor.

In embodiments, the module further comprises the temporary workspace floor, which is movable between an elevated parking level above the rig floor surface and a lowered operational position in which said operator is allowed to stand in said well centre opening on said work space floor, allowing said operator to secure said one or more control/and or signal lines externally to said tubulars string suspended from said module slip device. In embodiments, the temporary workspace floor is still suspended from and supported by the control and signal lines deployment module when positioned in the clear space at a level below the rig floor surface.

The invention also relates to a method for deployment of a tubulars string to which one or more control and/or signals lines are externally secured into a well, wherein use is made of a combination and/or a deployment module as described herein.

The invention also relates to a method for deployment of a tubulars string to which one or more control and/or signals lines are externally secured into a well, wherein use is made of a drilling installation having a rig floor with a well centre opening and a rig floor surface, wherein a rig floor slip device is provided that is arrangeable at said well centre opening, wherein the method comprises:

- clearing the rig floor slip device from said well centre opening;
- mounting a temporary workspace floor in the cleared well centre opening at a level below the rig floor surface to provide a workspace floor for an operator standing in said well centre opening on said workspace floor;
- placing a control and signal lines deployment module in an operative position, wherein a support structure of the control and signal lines deployment module is positioned over the well centre opening such that a work platform supported by the support structure is at a height above the rig floor surface, wherein said module comprises a module slip device supported by the support structure at a height above the rig floor surface;

building a tubulars string, involving suspending said tubulars string from said module slip device through the well centre opening;

guiding one or more control and/or signal lines below said work platform from one or more supply spools along one or more paths to a securing level between said module slip device and said workspace floor, e.g. at the height of the rig floor surface;

securing said one or more control/and or signal lines externally to said tubulars string suspended from said module slip device.

The invention also relates to a method for a using drilling installation for drilling a well to deploy a second tubulars string to which one or more control and/or signals lines are externally secured, the method comprising the steps of:

drilling a well by a drilling installation having a rig floor with a well centre opening and a rig floor surface and a rig floor slip device arranged at said well centre opening;

after drilling, clearing the rig floor slip device from said well centre opening;

mounting a temporary workspace floor in the cleared well centre opening at a level below the rig floor surface to provide a workspace floor for an operator standing in said well centre opening on said work space floor;

moving a control and signal lines deployment module from a parking position to an operative position;

positioning a support structure of the control and signal lines deployment module over the well centre opening such that a work platform supported by the support structure, is at a height above the rig floor;

providing a second tubular to a module slip device supported by the support structure at a height above the rig floor surface;

an operator standing on said work platform being able to reach a top end of the slip device;

building a second tubulars string and suspending from said module slip device said second tubulars string through the well centre opening;

guiding one or more control and/or signal lines below said work platform from one or more supply spools along a path to a securing level below said module slip device;

allowing said operator to secure said one or more control/ and or signal lines externally to said tubulars string suspended from said module slip device.

A second aspect of the invention relates to a combination of a drilling installation for drilling a well and a control and signal lines deployment module, wherein the drilling installation comprises:

a drilling tower;

a rig floor having a well centre opening and a rig floor surface;

wherein the control and signal lines deployment module is adapted to deploy a tubulars string to which one or more control and/or signals lines are externally secured through said well centre opening into the well;

which control and signal lines deployment module comprises:

a support structure adapted to be positioned over the well centre opening in an operative position;

a work platform supported by the support structure, which work platform is at a height above the rig floor surface in the operative position of the control and signal lines deployment module;

one or more line guides below said work platform and adapted to guide one or more control and/or signal lines from one or more supply spools along a path to a securing level below said module slip device allowing an operator to secure said one or more control and/or signals lines externally to said second tubulars string suspended from said module slip device;

characterized in that the control and signal lines deployment module in an operative position is provided heave compensated above the well centre opening.

In embodiments, the support structure of the control and signal lines deployment module in the operative position is suspended either from a rigid riser tension frame which is supported heave compensated by the drilling tower or from an internally heave compensated riser tension frame supported by the drilling tower.

In alternative embodiments, the control and signal lines deployment module in the operative position is supported via heave compensation cylinders on the rig floor.

In embodiments, the control and signal lines deployment module further comprises a workspace floor, wherein in an operational position thereof said operator is allowed to stand on said work space floor, allowing said operator to secure at said securing level said one or more control/and or signal lines externally to said tubulars string suspended from said module slip device.

The second aspect of the invention further relates to a method for deployment of a tubulars string to which one or more control and/or signals lines are externally secured into a well, wherein use is made of a combination as described above.

Optional aspects described in relation to the first aspect of the invention are also applicable to the second aspect of the invention.

The invention is further explained in relation to the drawings, in which:

FIG. 1*a* shows a perspective view of a possible embodiment of a combination of a drilling installation and a control and signal lines deployment module according to the present invention, wherein the control and signal lines deployment module is in a remote parking position;

FIG. 1*b* shows in the same perspective view the combination of FIG. 1*a*, wherein the control and signal lines deployment module is in an operative position;

Figure 4:
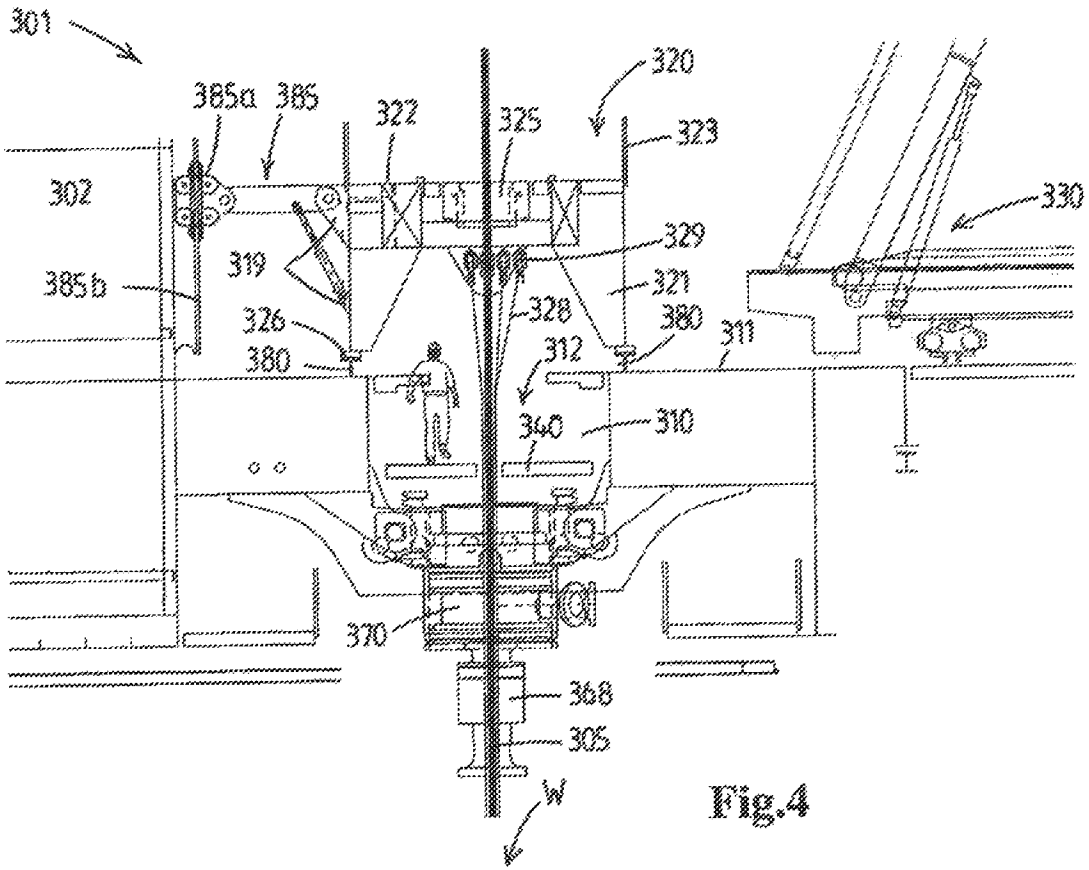
FIG. 4 is a cross-sectional side view of a combination of a drilling installation and a third embodiment of a control and signal lines deployment module according to the present invention in a first operative position.
Figure 5:
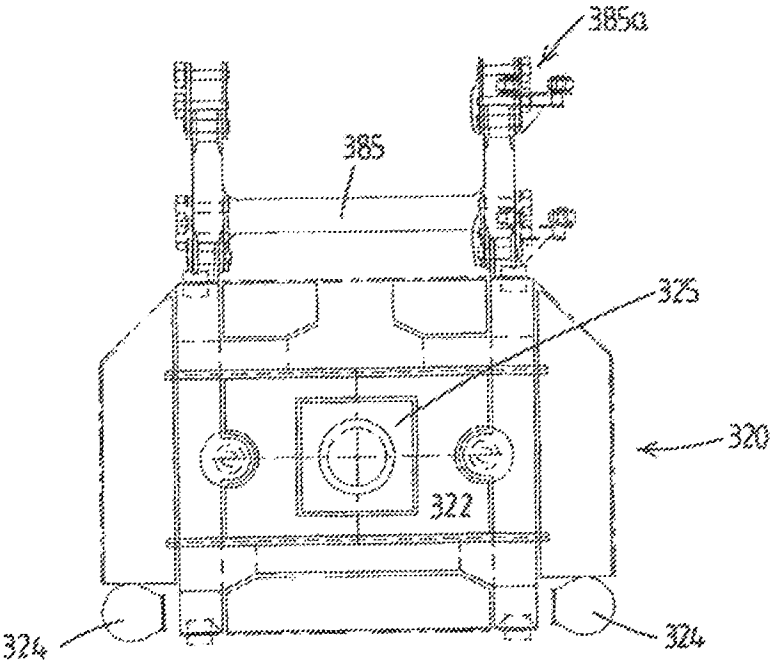
FIG. 5 is a top view of the control and signal lines deployment module of FIG. 4.
Figures 6A, 6B, 7A, 7B:
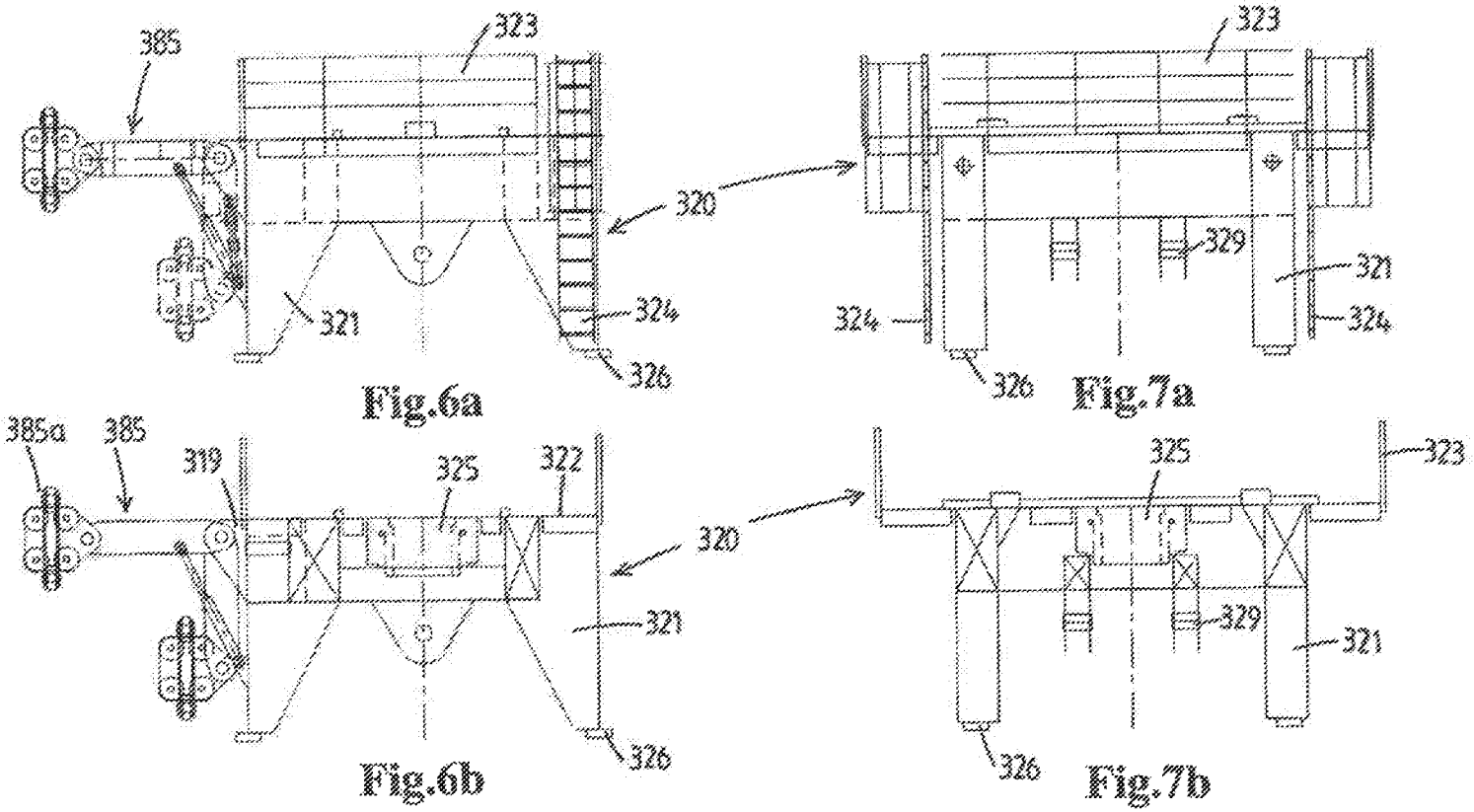
Figure 8:
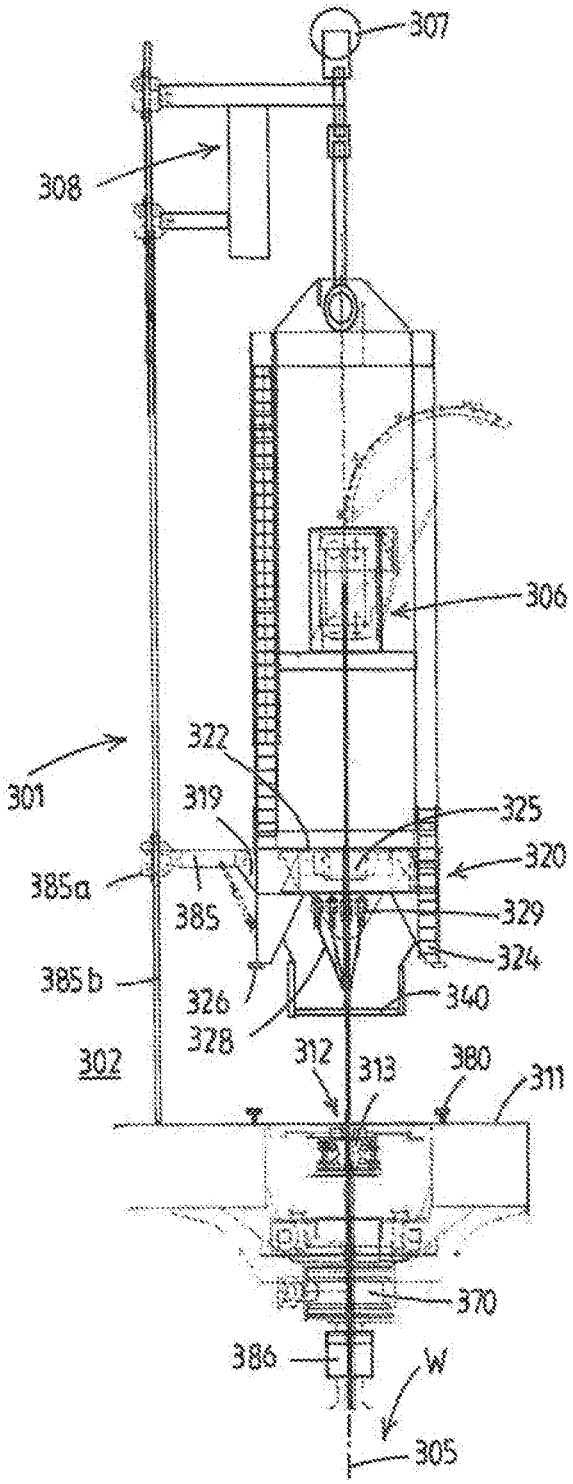
Figure 9B:
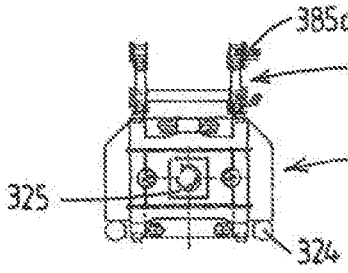
Figure 9A:
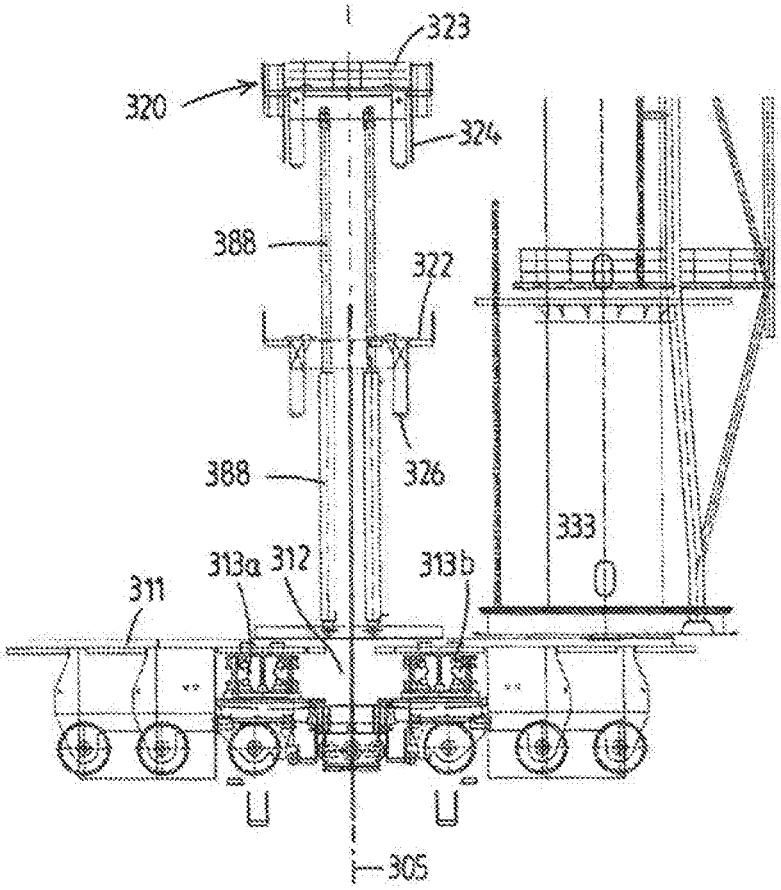

FIGS. 6*a* and 6*b* are a side view and cross section of the control and signal lines deployment module of FIG. 4, respectively;

FIGS. 7*a* and 7*b* are a front view and cross section of the control and signal lines deployment module of FIG. 4, respectively;

FIG. 8 is a cross-sectional side view of the combination of a drilling installation and control and signal lines deployment module of FIG. 4 in a second operative position supported by a rigid riser tension frame;

FIGS. 9*a* and 9*b* are a cross-sectional front view and top view respectively of the combination of a drilling installation and control and signal lines deployment module of FIG. 4 in a second operative position supported via heave compensation cylinders on the rig floor.

Figure 1A:
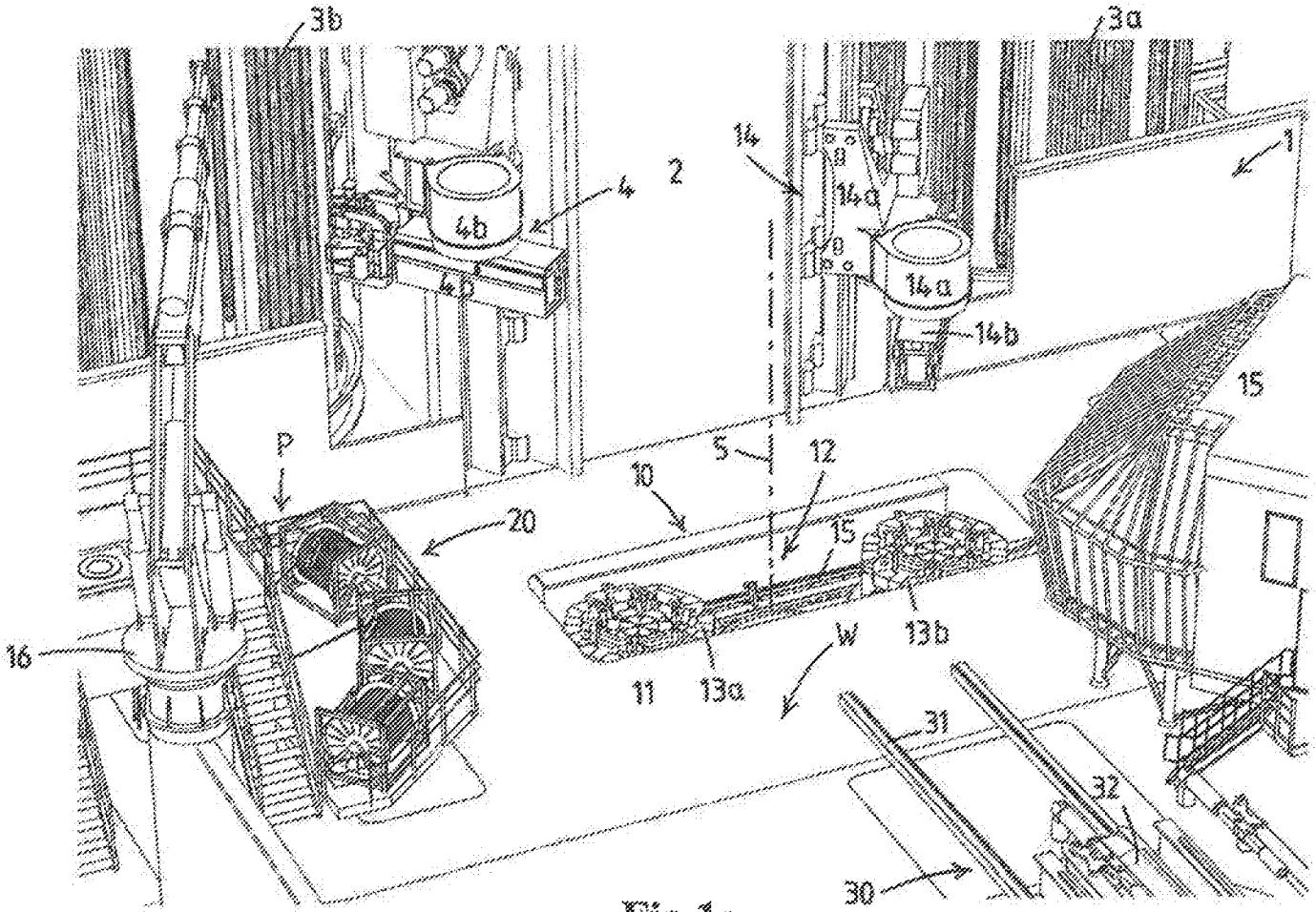
Figure 1B:
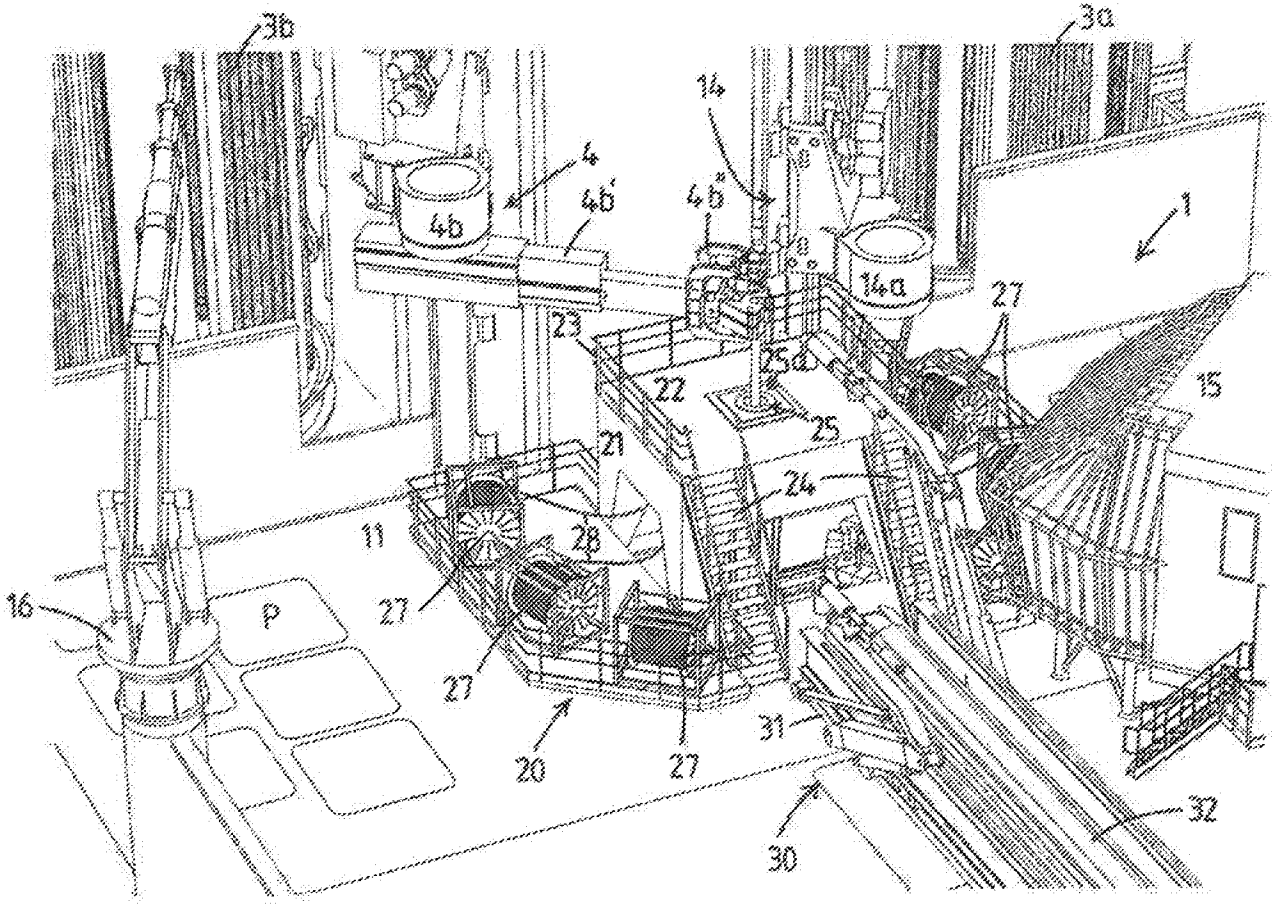

In FIGS. 1*a* and 1*b* a combination a drilling installation 1 for drilling a well and a control and signal lines deployment module 20 is shown. Possibly, the drilling installation is provided on a monohull vessel or a semi-submersible.

The shown drilling installation 1 comprises a drilling tower 2, here embodied as a mast of a closed construction.

Adjacent the drilling tower 2 there is a drilling tubulars storage rack 3*a*, 3*b* adapted to store multiple drilling tubulars, preferably multi-jointed tubular stands, in a vertical orientation.

Motion arm assemblies 4, 14 are mounted, advantageously movable in a vertical direction, to the drilling tower 2. Each assembly comprises a base 4*b*, 14*a* that is movable up and down along a vertical rail. A vertical axis bearing connects a telescopic motion arm 4*b*', 14*b* to said base.

In the depiction of FIGS. 1*a, b* it is shown that the arm 4*b*'carries an iron roughneck device 4*b*", whereas the arm 14*b* carriers a tubular gripper member (not visible) which, in combination with a further assembly 14 higher up along the tower, is operated as a pipe racker device. If desired, and as known in the art, above the assembly 4 one or more, e.g. two, further assemblies are arranged, that may equally be operated as pipe racker device.

Such a tubular racker devices are each adapted to grip and retain a tubular, e.g. a multi-joint tubular, e.g. three or more made-up tubulars, e.g. drill pipes or casing pipes, and to place a tubular in and remove a tubular from a respective tubulars storage rack 3*a*, 3*b*. The tubular racking devices have a reach at least allowing to transfer a tubular between the tubular storage rack 3*a*, 3*b* and a position of the tubular aligned with a firing line 5 above a well center so as to allow for building and disassembly of a first tubulars string, e.g. a drill string or a casing string.

The drilling installation 1 further comprises a rig floor having a well centre opening 12 around in the firing line 5 and a rig floor surface 11. In the shown embodiment the drilling tower 2 is positioned adjacent the rig floor. In embodiments, a moonpool is provided below the rig floor.

A rig floor slip device 13*a*, 13*b* is adapted to be arranged at said well centre opening 12, here below said rig floor surface 11, and to suspend therefrom a first tubulars string into a well, e.g. into a subsea riser extending between a subsea wellhead and the vessel as is known in the art. This situation is not shown in the drawings, but e.g. described in WO2014/182160 of the same applicant.

During drilling, one of the two shown rig floor slip devices 13*a*, 13*b* is arranged at the well centre opening 12, in the firing line 5. In this position, the rig floor slip device is adapted to suspend a first tubulars string, such as a casing string or drill pipe string.

It is noticed that with "rig floor" the actual floor construction is meant, whereas with "rig floor surface 11" the actual horizontal surface of the rig floor is meant.

In FIG. 1*a* it is visible that the well centre opening 12 is extended on opposite sides thereof to accommodate the slop devices 13*a*, 13*b* in their retracted or non-operable position.

Possibly, the rig floor comprises one or more mobile and/or removable covers (not shown), that are placed over spaces where the one or more slip devices 13*a, b* are placed in their retracted position, so as to leave only the well centre opening 12 open during drilling operations and deployment of a first tubular string. In FIG. 1*a* these covers are not shown in order to illustrate the retraction of the one or more slip devices 13*a, b*.

As is visible in FIG. 1*a*, the rig floor slip devices 13*a*, 13*b* are adapted to be cleared from said well centre opening 12 to create a clear space 10 around the firing line 5 in the well center opening.

Possibly, a rig floor slip device is not slidable as shown here into a retracted position, and instead the rig floor slip device is adapted to be lifted out of the well centre opening 12. In the shown embodiment, the rig floor slip devices 13*a*, 13*b* are displaceable along horizontal rails 15 that pass along the well centre opening 12 on opposite sides thereof.

In FIGS. 1*a* and 1*b*, furthermore a drillers' cabin 15 and an auxiliary crane 16 are visible.

Also a part of a catwalk device 30 is shown, comprising rails 31 and a catwalk machine frame 32. As is known in the art a catwalk machine is used to assist e.g. in advancing tubulars to the firing line.

Advantageously, the catwalk device 30 is adapted to supply of tubulars to be handled at the rig floor surface 11 and the supply of tubulars to be handled at the work platform 22 of the control and signal lines deployment module 20.

In cases, it is desired that a second tubulars string is deployed through said well centre opening into a well, to which one or more control and/or signals lines are externally secured. It is noticed that references to a first tubulars string relate to a string suspended from the rig floor slip device, and references to a second tubulars string relate to a tubulars string to which one or more control and/or signals lines are externally secured. The type of tubulars, e.g. drill pipe, casing, production tubing, may be the same: the difference is whether or not lines are secured to it.

A control and signal lines deployment module 20 is provided which is adapted to deploy such a second tubulars string through said well centre opening into a well, to which one or more control and/or signals lines are externally secured. The control and signal lines deployment module 20 is movable between an operative position, as shown in FIG. 1*b*, wherein the control and signal lines deployment module 20 is positioned on the rig floor over the well centre opening 12, and a remote parking position P, e.g. as visible in FIG. 1*a*.

The control and signal lines deployment module 20 comprises a support structure 21 that is adapted to stand on the rig floor in the operative position over the well centre opening 12.

A work platform 22 is supported by the support structure 21, which work platform is at a height above the rig floor surface 11 in the operative position of the module.

Together the support structure 21 and work platform 22 form a table-shaped structure. A fence 23 is provided at the outer contour of the work platform. Furthermore, stairs 24 are provided from the rig floor level to the work platform 22 to allow personnel to enter the work platform 22.

A module slip device 25 is supported by the support structure 21, here via or adjacent the work platform 22, which module slip device 25 is at a height above the rig floor surface in the operative position of the module and is adapted to suspend a second tubulars string through the well centre opening 12 in the firing line 5.

Preferably a top end 25*a* of said module slip device 25 is within reach of an operator standing on said work platform 22, e.g. during make-up of tubulars during building said second tubulars string.

The support structure 21 further supports one or more line guides, not visible in FIGS. 1*a* and 1*b*, below said work platform 22, which are adapted to guide one or more control and/or signal lines 28 from one or more supply spools 27 along a path to a securing level below said module slip device 25. At the securing level, an operator is allowed to secure said one or more control and/or signals lines externally to said second tubulars string suspended from said module slip device 25.

In the embodiment of FIGS. 1*a* and 1*b*, though not visible, said securing level is essentially level with the rig floor surface (11), +/−50 cm.

According to the present invention, the combination 1 further comprises a temporary workspace floor (not visible), which is adapted to be mounted in the clear space 10 at a level below the rig floor surface 11 and to provide a workspace floor for an operator standing in said clear space 10 on said work space floor, allowing said operator to secure at said securing level said one or more control/and or signal lines externally to said second tubulars string suspended from said module slip device 25.

In the shown embodiment, the workspace floor is advantageously adapted to be positioned onto the rails 15.

In the shown preferred embodiment, the support structure 21 of the control and signal lines deployment module 20 further supports one or more, here six supply spools 27. The shown supply spools have a horizontal axle. Here, the supply spools 27 are supported at a level just above the rig floor surface 11.

Possibly, but not visible in the drawings, the support structure 21 further supports securing tools at said securing level.

Figure 2:
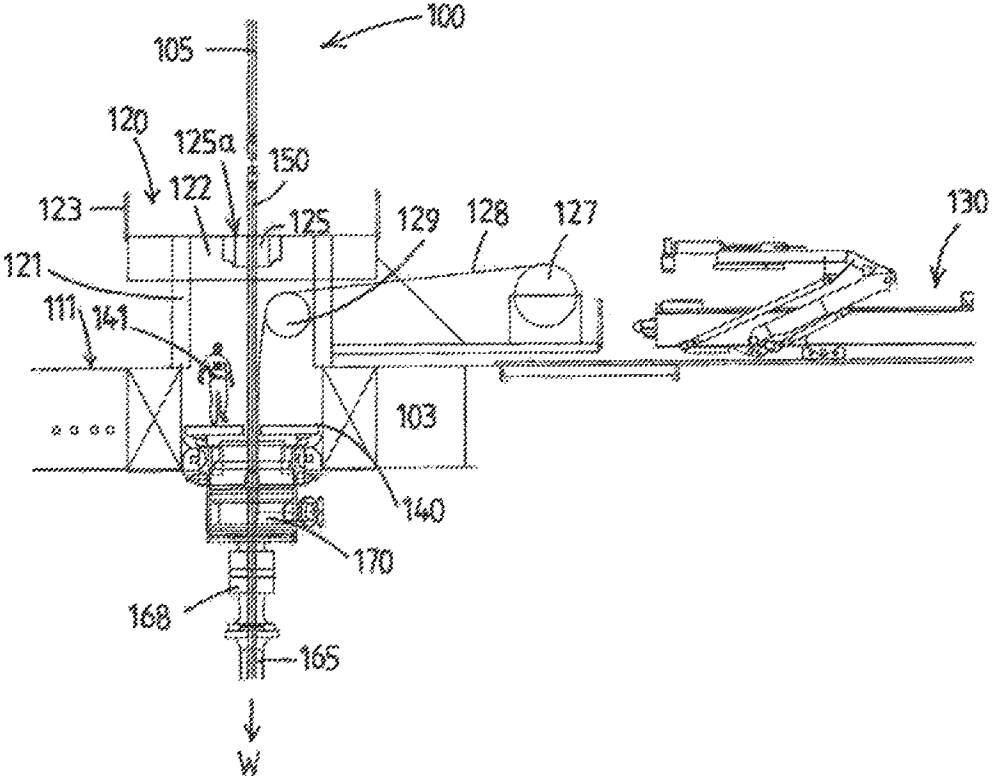
FIG. 2 is a cross-sectional side view of a combination of a drilling installation and a control and signal lines deployment module according to the present invention, wherein the control and signal lines deployment module is the operative position.

FIG. 2 shows a similar combination of a drilling installation 100 and a control and signal lines deployment module 120 according to the present invention, wherein the control and signal lines deployment module 120 is the operative position. Similar components of the embodiment of FIGS. 1*a* and 1*b* have been given the same reference numeral, to which '100' has been added.

Figure 3:
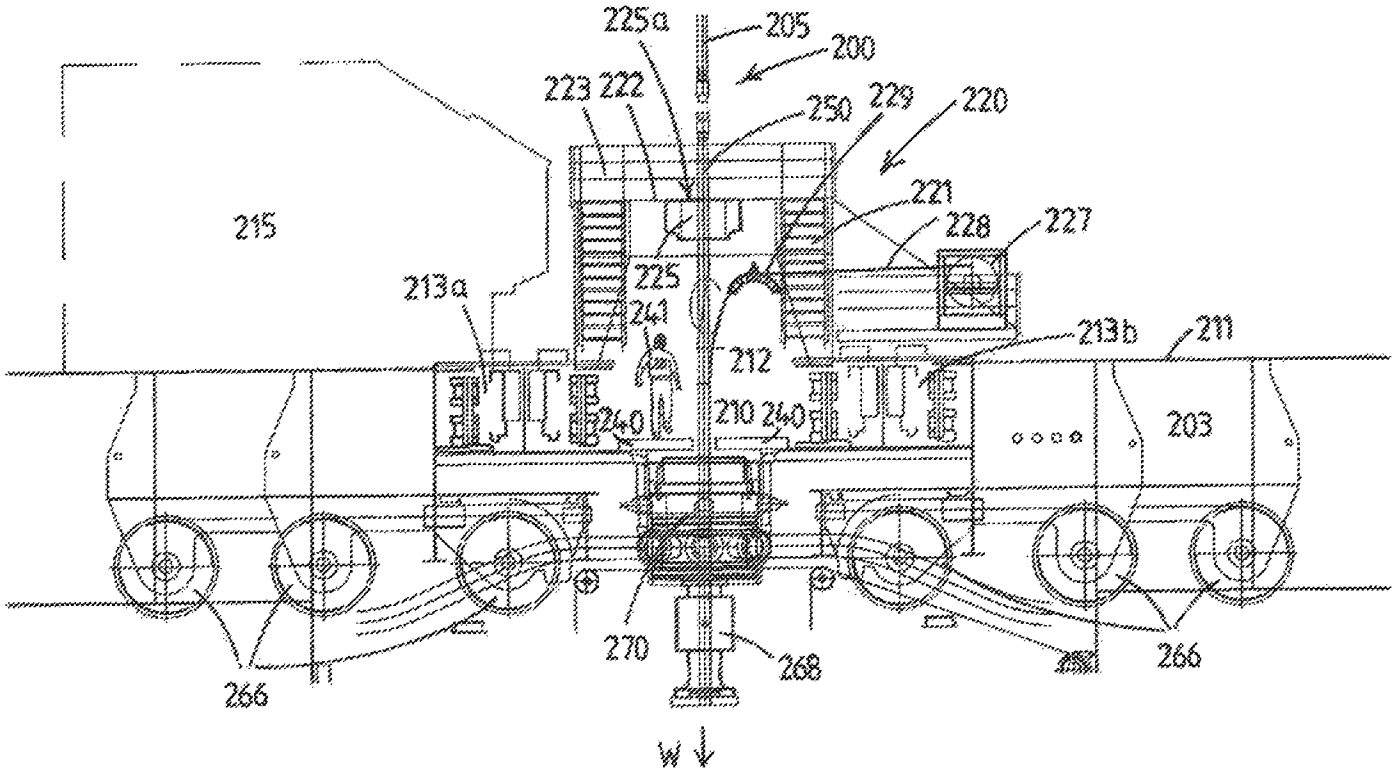
FIG. 3 is a cross-sectional side view of a combination of a drilling installation and a second embodiment of a control and signal lines deployment module according to the present invention, wherein the control and signal lines deployment module is the operative position.

FIG. 3 shows yet another similar combination of a drilling installation 200 and a control and signal lines deployment module 220 according to the present invention, wherein the control and signal lines deployment module 220 is the operative position. Similar components of the embodiment of FIGS. 1*a* and 1*b* have been given the same reference numeral, to which '200' has been added. The cross-section of FIG. 3 is taken in a plane perpendicular to the cross-sectional plane of FIG. 2.

The drilling installation 100 is adapted to drill a well W along a firing line 105 using a drilling tower (not shown), similar to that of FIGS. 1*a* and 1*b*. The drilling installation 100 comprises a rig floor 103, which is the actual support structure, having a well centre opening 112 and a rig floor surface 111.

At the right-hand side of the drawing, a catwalk device 130 is visible, provided on the rig floor surface 111. Such a catwalk device 130 is able to present tubulars to the firing line 105.

To perform drilling operations, below the rig floor surface 111, a rig floor slip device is arranged at the well centre opening 112.

Furthermore, a riser tensioner system is provided in the firing line 105, which is adapted to be connected to a top end of a riser string, in order to suspend the riser string from in the firing line 105. In the shown embodiment, the riser tensioner system comprises a telescopic joint, which is sometimes also referred to as a slip joint, comprising an inner barrel 165 and an outer barrel with a seal there between. A riser tensioner ring (not shown) is adapted to be connected to the top of the outer barrel.

In this embodiment, the riser tensioner system further comprises a top flex joint 168 above the inner barrel 165 of the telescopic joint, to provide lateral restraint and reduce rotation through elastomeric stiffness elements. Also a diverter 170 is located just above the top flex joint 168 and just below the rig floor slip device (not shown) allowing mud with drill cuttings returning from the well through the riser to be dumped to a mud processing system.

In the drawing, there is no rig floor slip device arranged at the well centre opening 112. According to the present invention, the rig floor slip device has cleared from said well centre opening 112 to create a clear space 110 around the well centre opening.

Instead, according to the present invention, the combination further comprises a temporary workspace floor 140, which in the shown configuration is mounted in the clear space 110 at a level below the rig floor surface 111 to provide a workspace floor 140 for an operator 141 standing in said clear space 110 on said work space floor 140.

The temporary workspace floor 140 is thus positioned closely spaced above and almost directly on top of the diverter 170. Because of its function, this diverter 170 is not adapted to be cleared from said wall centre opening.

The combination of the invention further comprises a control and signal lines deployment module 120, which is adapted to deploy a second tubulars string 150 to which one or more control and/or signals lines 128 are externally secured through said well centre opening 112 into the well W. The control and signal lines deployment module 120 is movable between an operative position, as shown, wherein the control and signal lines deployment module 120 is positioned on the rig floor over the well centre opening 112, and a remote parking position.

The control and signal lines deployment module 120 comprises a support structure 121, standing on the rig floor in the operative position over the well centre opening 112. It further comprises a work platform 122 supported by the support structure 121, which work platform is at a height above the rig floor surface 111 in the operative position of the control and signal lines deployment module 120. A fence 123 is provided around the work platform 122.

The control and signal lines deployment module 120 further comprises a module slip device 125 supported by the support structure, which module slip device is at a height above the rig floor surface 111 in the operative position of the module, here just above the rig floor surface, and is adapted to suspend a second tubulars string 150 through the well centre opening such that a top end 125*a* of said module slip device 125 is within reach of an operator standing on said work platform 122.

The control and signal lines deployment module 120 further comprises one or more line guides 129, here embodied as a guide wheel, below said work platform 122 and adapted to guide one or more control and/or signal lines 128 from one or more supply spools 127 along a path to a securing level S below said module slip device allowing an operator to secure said one or more control and/or signals lines externally to said second tubulars string suspended from said module slip device.

Workspace floor 140 allows operator 141 to stand in said clear space 110 and to secure at said securing level S said one or more control/and or signal lines 128 externally to said second tubulars string 150 suspended from said module slip device 125.

FIG. 3 shows yet another similar combination of a drilling installation 200 and a control and signal lines deployment module 220 according to the present invention, wherein the control and signal lines deployment module 220 is the operative position. Similar components of the embodiment of FIGS. 1*a* and 1*b* have been given the same reference numeral, to which '200' has been added. The cross-section of FIG. 3 is taken in a plane perpendicular to the cross-sectional plane of FIG. 2.

The drilling installation 200 is adapted to drill a well W in a firing line 205 using a drilling tower (not shown), similar to that of FIGS. 1*a* and 1*b*. The drilling installation 200 comprises a rig floor 203, which is the actual support structure, having a well centre opening 212 and a rig floor surface 211.

At the left-hand side of the drawing drillers cabin 215 is visible, provided on the rig floor surface 111.

To perform drilling operations, below the rig floor surface 211, a rig floor slip device 213*a*, 213*b* is arranged at the well centre opening 212. This is not the situation shown in FIG. 3.

Furthermore, a riser tensioner system is provided in the firing line 205, which is adapted to be connected to a top end of a riser string, in order to suspend the riser string from in the firing line 205. In the shown embodiment, the riser tensioner system comprises a telescopic joint, which is sometimes also referred to as a slip joint, comprising an inner barrel and an outer barrel with a seal there between. A riser tensioner ring (not shown) is adapted to be connected to the top of the outer barrel. The riser tensioning system further comprises cables sheaves 266 and cylinders (not shown), wherein the cables extend from the riser tensioner ring to the cylinders via sheaves 266. In this embodiment, the riser tensioner system further comprises a top flex joint 268 above the inner barrel of the telescopic joint, to provide lateral restraint and reduce rotation through elastomeric stiffness elements.

Also a diverter 270 is located just above the top flex joint 268 and just below the rig floor slip device (not shown) allowing mud with drill cuttings returning from the well through the riser to be dumped to a mud processing system.

In the drawing, the rig floor slip devices 213*a*, 213*b* arranged adjacent the well centre opening 212. According to the present invention, the rig floor slip devices 213*a*, 213*b* have cleared from said well centre opening 212 to create a clear space 210 around the well centre opening.

Instead, according to the present invention, the combination further comprises a temporary workspace floor 240, which in the shown configuration is mounted in the clear space 210 at a level below the rig floor surface 211 to provide a workspace floor 240 for an operator 241 standing in said clear space 210 on said work space floor 240.

The temporary workspace floor 440 is thus positioned closely spaced above and almost directly on top of the diverter 770. Because of its function, this diverter 270 is not adapted to be cleared from said wall centre opening.

The combination of the invention further comprises a control and signal lines deployment module 220, which is adapted to deploy a second tubulars string 250 to which one or more control and/or signals lines 228 are externally secured through said well centre opening 212 into the well W. The control and signal lines deployment module 220 is movable between an operative position, as shown, wherein the control and signal lines deployment module 220 is positioned on the rig floor over the well centre opening 212, and a remote parking position.

The control and signal lines deployment module 220 comprises a support structure 221, standing on the rig floor in the operative position over the well centre opening 212. It further comprises a work platform 222 supported by the support structure 121, which work platform is at a height above the rig floor surface 111 in the operative position of the control and signal lines deployment module 120. A fence 123 is provided around the work platform 122.

The control and signal lines deployment module 220 further comprises a module slip device 225 supported by the support structure, which module slip device is at a height above the rig floor surface 211 in the operative position of the module, here just above the rig floor surface, and is adapted to suspend a second tubulars string 250 through the well centre opening such that a top end 225*a* of said module slip device 225 is within reach of an operator standing on said work platform 222.

The control and signal lines deployment module 220 further comprises one or more line guides 229, here embodied as a roller guide, below said work platform 222 and adapted to guide one or more control and/or signal lines 228 from one or more supply spools 227 along a path to a securing level S below said module slip device allowing an operator to secure said one or more control and/or signals lines externally to said second tubulars string suspended from said module slip device. The supply spools 227 are also supported by the support structure 221 at a level just above the rig floor surface 211.

Workspace floor 240 allows operator 241 to stand in said clear space 210 and to secure at said securing level S said one or more control/and or signal lines 228 externally to said second tubulars string 250 suspended from said module slip device 225.

In FIGS. 4-9 a third embodiment of a control and signal lines deployment module 320 is shown in various positions and views. The control and signal lines deployment module 320 comprises:

- a support structure 321;
- a work platform 322 supported by the support structure 321,
- a module slip device 325 supported by the support structure,
- one or more line guides 329 below said work platform and adapted to guide one or more control and/or signal lines 328 from one or more supply spools along a path to a securing level below said module slip device allowing an operator to secure said one or more control and/or signals lines externally to said second tubulars string suspended from said module slip device.

Together the support structure 321 and work platform 322 form a table-shaped structure with downward protruding legs. A fence or railing 323 is provided at the outer contour of the work platform. Furthermore, stairs 324, here embodied as a (partially) caged ladder, are provided to allow personnel to enter the work platform 322.

In this third embodiment of the control and signal lines deployment module 320 the support structure 321 comprises shoes 326 allowing movement along rails 380. This provides mobility of the control and signal lines deployment module 320 between an operative position and a remote parking position.

Furthermore, this third embodiment of the control and signal lines deployment module 320 is provided with connectors 319, allowing the control and signal lines deployment module 320 to be connected to a tension frame 385. Such tension frames are commonly known frames, adapted to provide heave compensation to the object supported by the frame. Both rigid riser tension frames are known, which are supported heave compensated by a drilling tower, and internally heave compensated riser tension frames, supported by a drilling tower. The tension frame 385 is provided with guides 385*a*, adapted to engage a rail 385*b* provided along the drilling tower and to be moveable along the drilling tower.

In FIGS. 4, 8 and 9 the control and signal lines deployment module 320 is shown in combination with a drilling installation 301 for drilling a well W. The drilling installation 301 comprises:

a drilling tower 302;

a rig floor having a well centre opening 312 in firing line 305 and a rig floor surface 311;

a rig floor slip device 313; 313*a*, 313*b* which is adapted to be arranged at said well centre opening and to suspend therefrom a first tubulars string into the well.

The work platform 322 of the control and signal lines deployment module 320 is at a height above the rig floor surface 311 in the operative position of the control and signal lines deployment module 320. The module slip device 325 is also provided at a height above the rig floor surface 311 in the operative position of the control and signal lines deployment module and is adapted to suspend a second tubulars string through the well centre opening such that a top end of said module slip device 325 is within reach of an operator standing on said work platform 322.

In FIG. 4, furthermore a catwalk device 330 is shown. In FIG. 9*a* furthermore a tubulars storage 333 is visible, adapted to store multiple drilling tubulars, preferably multi-jointed tubular stands, in a vertical orientation. The tubulars storage 333 is provided adjacent the drilling tower 302, which is not visible in this front view, similar to the setup as shown in FIGS. 1*a* and 1*b*.

Furthermore, a riser tensioner system is provided in firing line 305, which is adapted to be connected to a top end of a riser string, in order to suspend the riser string from in the firing line 305. In this embodiment, the riser tensioner system comprises a top flex joint 368 above a telescopic joint, to provide lateral restraint and reduce rotation through elastomeric stiffness elements. Also a diverter 370 is located just above the top flex joint 368 and just below the rig floor slip device allowing mud with drill cuttings returning from the well through the riser to be dumped to a mud processing system.

In FIG. 4, the rig floor slip device is not shown. In FIG. 8 is the rig floor slip device 313 shown at the well centre opening and in FIG. 9 have parts 313*a* and 313*b* moved apart, thereby clearing the well centre opening 312 to create a clear space around the well centre opening.

In FIG. 4, the support structure 321 of the control and signal lines deployment module 320 is shown in a first operative position, in which the support structure stands stationary on the rig floor over the well centre opening. In particular, the support structure 321 is supported via the shoes 326 by rails 380 provided on the rig floor surface 311.

In FIGS. 4 and 8, it is visible that tension frame 385 is supported by the drilling tower 302. In FIG. 4, this support does not provide heave compensation as the control and signal lines deployment module 320 is fully supported by the rig floor surface. The tension frame 385 supported by the drilling tower may provide stability in the horizontal plane, but may optionally also be dispensed with.

In FIG. 8, the control and signal lines deployment module 320 is not supported by the rig floor surface, but provided in a second operative position heave compensated above the well centre opening 312, being supported by the tension frame 385.

Further, as visible in FIG. 8, tension frame 385 also supports a coiled tubing injector 306, adapted to supply coiled tubing to or through the module slip device 325 of the control and signal lines deployment module 320, which module slip device 325 is at a height above the rig floor surface in the operative position of the module and is adapted to suspend a second tubulars string through the well centre opening in the firing line.

The tension frame 385 with injector head 306 and control and signal lines deployment module 320 is supported heave compensated via a travelling block 307 supporting a trolley 308 guided along vertical rails 385*b*.

In FIG. 8, the control and signal lines deployment module 320 is provided in a second operative position heave compensated above the well centre opening 312 supported by the drilling tower.

In FIG. 9*a, b* heave compensation cylinders 388 are provided on the rig floor, supporting the control and signal lines deployment module 320 in a second operative position heave compensated above the well centre opening.

In FIG. 4, a temporary workspace floor 340 according to the first aspect of the invention is provided, here mounted in the clear space 310 at a level below the rig floor surface 311. The clear space 310 is created by clearance of the rig floor slip device (not visible) from the well centre opening 312. The workspace floor 340 provides a workspace floor for an operator standing in said clear space 310 on said work space floor, allowing said operator to secure at said securing level said one or more control/and or signal lines externally to said second tubulars string suspended from said module slip device 325.

In FIG. 8, the temporary workspace floor 340 is also provided, to provide a workspace floor for an operator on said work space floor, allowing said operator to secure at said securing level said one or more control/and or signal lines externally to said second tubulars string suspended from said module slip device 325. In the position of the tension frame 385 of FIG. 8, the temporary workspace floor 340 is suspended from the control and signal lines deployment module 320 at an elevated level above the rig floor surface 311, hence, according to the second aspect of the invention.

It is also conceivable that the tension frame 385 is positioned closer to the rig floor. Once the rig floor slip device 313 is cleared from the well centre opening 312, a clear space would be created in which the temporary workspace floor 340 can be provided, according to the first aspect of the invention. In such a not shown embodiment, both the control and signal lines deployment module and the temporary workspace floor suspended therefrom are provided heave compensated by the tension frame 385.

In FIGS. 9*a* and 9*b*, another embodiment of a combination according to the second aspect of the invention is shown. The control and signal lines deployment module 320 is shown in an operative position above the well centre opening, in which position it is provided heave compensated.

In this example heave compensation is provided via heave compensation cylinders 388, here four as can be seen in FIG. 9*b*, arranged between the rig floor and the module 320. In FIG. 9*a*, the heave compensation cylinders 388 are shown both in their fully retracted and fully extended position, between which positions heave compensation can be carried out. In the shown embodiment, there is no temporary workspace floor below the platform of the module. During particular wellbore operations, it is conceivable that such workspace floor can be dispensed with. For example when the module 320 support a slip device to keep a tubular string in heave compensated mode in the firing line without the need for attachment of any control or signal lines.

The invention claimed is:

1. A combination of a drilling installation for drilling a well and a control and signal lines deployment module, wherein the drilling installation comprises:

a drilling tower; and a rig floor having a well centre opening and a rig floor surface, wherein the control and signal lines deployment module is adapted to deploy a tubulars string to which one or more control and/or signals lines are externally secured through said well centre opening into the well, wherein the control and signal lines deployment module comprises:

a support structure adapted to be positioned over the well centre opening in an operative position;

a work platform supported by the support structure, the work platform being at a height above the rig floor surface in the operative position of the control and signal lines deployment module;

a module slip device supported by the support structure, the module slip device being at a height above the rig floor surface in the operative position of the control and signal lines deployment module and being adapted to suspend the tubulars string through the well centre opening; and one or more line guides below said work platform and adapted to guide one or more control and/or signal lines from one or more supply spools along a path to a securing level below said module slip device allowing an operator to secure said one or more control and/or signals lines externally to said tubulars string suspended from said module slip device, wherein the control and signal lines deployment module in an operative position is provided heave compensated above the well centre opening.

2. The combination of claim 1, wherein the support structure of the control and signal lines deployment module in the operative position is suspended either from a rigid riser tension frame supported heave compensated by the drilling tower or from an internally heave compensated riser tension frame supported by the drilling tower.

3. The combination of claim 1, wherein the support structure of the control and signal lines deployment module is supported via heave compensation cylinders on the rig floor.

4. The combination according to claim 1, wherein the control and signal lines deployment module further comprises a workspace floor, wherein in an operational position of said workspace floor said operator is allowed to stand on said work space floor, allowing said operator to secure at said securing level said one or more control/and or signal lines externally to said tubulars string suspended from said module slip device.

5. The combination according to claim 1, further comprising a rig floor slip device adapted to be arranged at said well centre opening and to suspend therefrom a tubulars string into the well.

6. The combination according to claim 1, wherein the support structure further supports one or more supply spools for said one or more control and/or signal lines.

7. The combination according to claim 1, wherein said securing level is essentially at the same level as the rig floor surface.

8. The combination according to claim 1, wherein the control and signal lines deployment module further comprises a temporary workspace floor, movable between an elevated parking level above the rig floor surface and a lowered operational position in which said operator is allowed to stand in said well centre opening on said work space floor, allowing said operator to secure said one or more control/and or signal lines externally to said tubulars string suspended from said module slip device.

9. The combination according to claim 8, wherein the drilling installation comprises a diverter, and wherein the temporary workspace floor is positioned closely spaced above the diverter.

10. The combination according to claim 1, wherein the control and signal lines deployment module in a second operative position thereof is adapted to stand stationary on the rig floor over the well centre opening.

11. A method for deployment of a tubulars string to which one or more control and/or signals lines are externally secured into a well, said method comprising using the combination according to claim 1.

12. A method for deployment of a tubulars string to which one or more control and/or signals lines are externally secured into a well, wherein use is made of a combination of a drilling installation for drilling the well and a control and signal lines deployment module, wherein the drilling installation comprises a drilling tower and a rig floor with a well centre opening and a rig floor surface, wherein the control and signal lines deployment module is adapted to deploy a tubulars string to which the one or more control and/or signals lines are externally secured through said well centre opening into the well, wherein control and signal lines deployment module comprises:

a support structure adapted to be positioned over the well centre opening in an operative position;

a work platform supported by the support structure, the work platform being at a height above the rig floor surface in the operative position of the control and signal lines deployment module;

a module slip device supported by the support structure, the module slip device being at a height above the rig floor surface in the operative position of the control and signal lines deployment module and is adapted to suspend the tubulars string through the well centre opening; and one or more line guides below said work platform and adapted to guide one or more control and/or signal lines from one or more supply spools along a path to a securing level below said module slip device allowing an operator to secure said one or more control and/or signals lines externally to said tubulars string suspended from said module slip device, wherein the control and signal lines deployment module in an operative position is provided heave compensated above the well centre opening, and wherein the method comprises:

placing the control and signal lines deployment module in the operative position, wherein the support structure of the control and signal lines deployment module is positioned over the well centre opening such that the work platform supported by the support structure is at a height above the rig floor surface;

guiding one or more control and/or signal lines below said work platform from one or more supply spools along one or more paths to the securing level; and securing said one or more control/and or signal lines externally to said tubulars string suspended from said module slip device.

* * * * *